United States Patent [19]

Divers et al.

[11] 4,282,802

[45] Aug. 11, 1981

[54] SLIDEBOARD DEVICE FOR UNDERGROUND MINE FACE VENTILATION

[75] Inventors: Edward F. Divers; John C. LaScola, both of Pittsburgh, Pa.

[73] Assignee: The United States of America as represented by the Secretary of the Interior, Washington, D.C.

[21] Appl. No.: 136,126

[22] Filed: Mar. 31, 1980

[51] Int. Cl.[3] ..... F24F 7/00

[52] U.S. Cl. ..... 98/50; 299/12

[58] Field of Search ..... 98/50; 299/12; 160/351, 160/354

[56] References Cited

U.S. PATENT DOCUMENTS

| | | | |
|---|---|---|---|
| 2,292,785 | 8/1942 | Henne | 160/354 X |
| 3,712,678 | 1/1973 | Amoroso | 299/12 X |
| 3,715,969 | 2/1973 | Burgess, Jr. | 98/50 |
| 4,056,903 | 11/1977 | Guarnere | 160/351 |
| 4,157,204 | 6/1979 | Kissell et al. | 299/64 |

FOREIGN PATENT DOCUMENTS

| | | | |
|---|---|---|---|
| 620491 | 10/1935 | Fed. Rep. of Germany | 299/12 |

*Primary Examiner*—Albert J. Makay
*Assistant Examiner*—Harold Joyce
*Attorney, Agent, or Firm*—Thomas Zack; Donald A. Gardiner

[57] ABSTRACT

A slideboard for underground mine face ventilation which acts as an extension of a line brattice. When used, the slideboard is advanced towards the working face of the mine to provide an inlet for clean air and an outlet for exhausting gases laden with dust particles. The slideboard has a frame supported on and slideable with respect to the ground as it is advanced along with a continuous mining machine. At the upper portion of the slideboard frame are a series of halflooped hoses which provide a flexible seal with the roof. The main supporting frame is rigid and is formed by a series of vertical and horizontal members whose narrower edges face into the air stream to reduce air friction and increase rigidity. Near the center of the slideboard a rib strut and outrigger provide lateral support and a sliding surface and pivot point. The base of the slideboard is trapezoidal for structural reinforcement; and a plywood gusset in the panel place provides additional reinforcement. The outby end panel of the slideboard is hinged to seat lightly against the line brattice to form an air seal therewith. The entire frame, including the outby end panel, and the upper half-loop hoses are covered with an air impervious layer of brattice cloth material.

5 Claims, 2 Drawing Figures

SLIDEBOARD DEVICE FOR UNDERGROUND MINE FACE VENTILATION

BACKGROUND OF THE INVENTION

1. Field of the Invention

The invention disclosed herein is a slideboard used in underground mines to provide air control near a mine working face.

2. Description of the Prior Art

Various types of line brattices have been used to seal, control, and direct the flow of air in underground mines. Those of particular relevancy to the instant invention are the extensible curtain type wherein all or a portion of the line curtain is advanced towards the mine working face as a material cutting machine advances. One example of such an extensible line curtain is the U.S. Pat. No. 3,715,969 (J. V. Burgess, Jr.). When such brattices are used in conjunction with continuous mining machines, it is essential that they provide effective air seals so that the air flow is directed to and from the mine working face where most of the dust and gas is generated. The seal must be flexible and strong enough to allow it to easily conform to the irregular contours of the mine roof and cooperating stationary brattice panel. At the same time the extensible brattice panel must be easily movable so it can move towards the mine working face with the advancing continuous miner. The U.S. Pat. No. 4,157,204 (F. N. Kissell et al) provides such a movable panel and an effective air seal.

To provide for an extensible panel which can be easily moved and still provide the necessary sealing needed, we have invented a self-supporting easily slidable slideboard panel. To do this, there is a roof seal provided by a series of flexible roof engaging members on its upper portion, a vertically hinged portion to overlap and provide an effective air seal with a stationary air curtain, and a reinforced trapezoidal base and gusset panel for the leading edge. None of the known prior art provides for all of these features in one simple, effective, mobile unit.

SUMMARY OF THE INVENTION

The self-supporting ground mounted slidable panel making up this invention is employed in conjunction with a stationary line bratttice curtain. Facing in the same general direction as the line curtain is the slideboard device forming this invention. Forming part of the slideboard is a rigid frame which is covered by an impervious layer of brattice cloth. The frame is made from rigid interconnected members which are oriented to reduce air friction and to increase the frame's rigidity. A vertical support rib strut and outrigger is mounted to extend from near the lower center side of the frame and provides a sliding surface, a pivot point, and a spacer to prevent high airflows from forcing the slideboard into the mine wall. The inby or front edge of the frame has an additional panel support and the outby or rear edge is vertically hinged to allow the overlapping rear sideboard section to seat light against the line brattice and form a seal therewith. A flexible upper surface mounted to the frame and covered by the brattice cloth allows the assembly to adjust to different irregularities in the roof.

The primary object of this invention is an improved slideboard air control device for use as a mine ventilation curtain that allows the curtain to be advanced without forcing the operator to go under unsupported roof.

The benefits derived from producing effective adequate underground mine ventilation are very well known. When continuous mining machines are employed to cut coal from a working face the law requires that the depth of greatest cut into the coal face can never be greater than 10 feet from the line curtain (CFR 75.302-1). In order to comply with this requirement, the present invention was developed. The commonly assigned U.S. Pat. No. 4,157,204 (Fred N. Kissell et al) is concerned with this same problem and its contents are specifically incorporated by reference herein.

Figure 1:
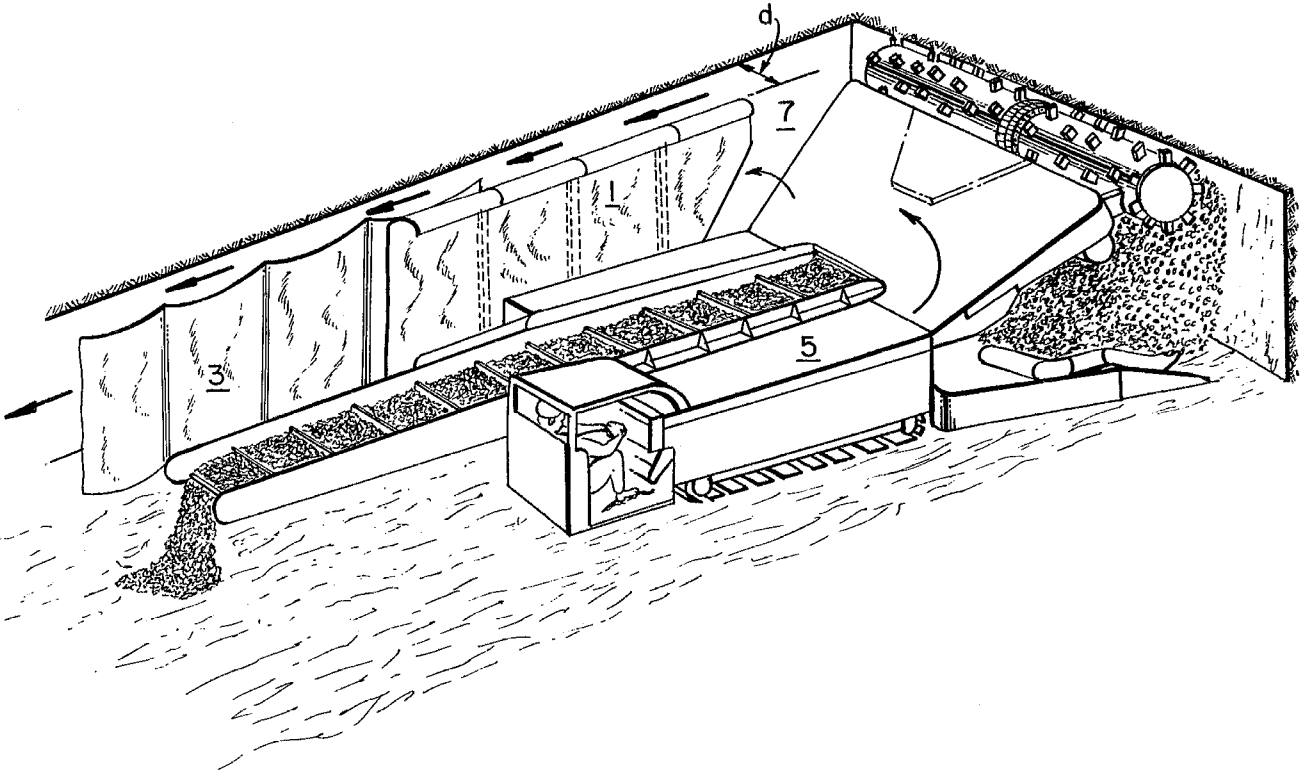
FIG. 1 is a schematic illustrating how this invention would typically be used in an undergound mine with a conventional line brattice curtain and mining machine.

FIG. 1 illustrates how the references would normally be used within an underground mine such as a coal mine. The preferred embodiment of the slideboard device 1 is placed on the mine floor with its rear or outby edge section overlapping the front part of the stationary line brattice curtain 3. As the continuous mining machine 5 cuts coal from the working face, there is an air flow in the direction of the arrows from the working face to the space "d" between the curtain/slideboard and mine wall or rib 7. Typically this space d would be about 30 inches wide and run the height of the rib along the length of the curtains.

Figure 2:
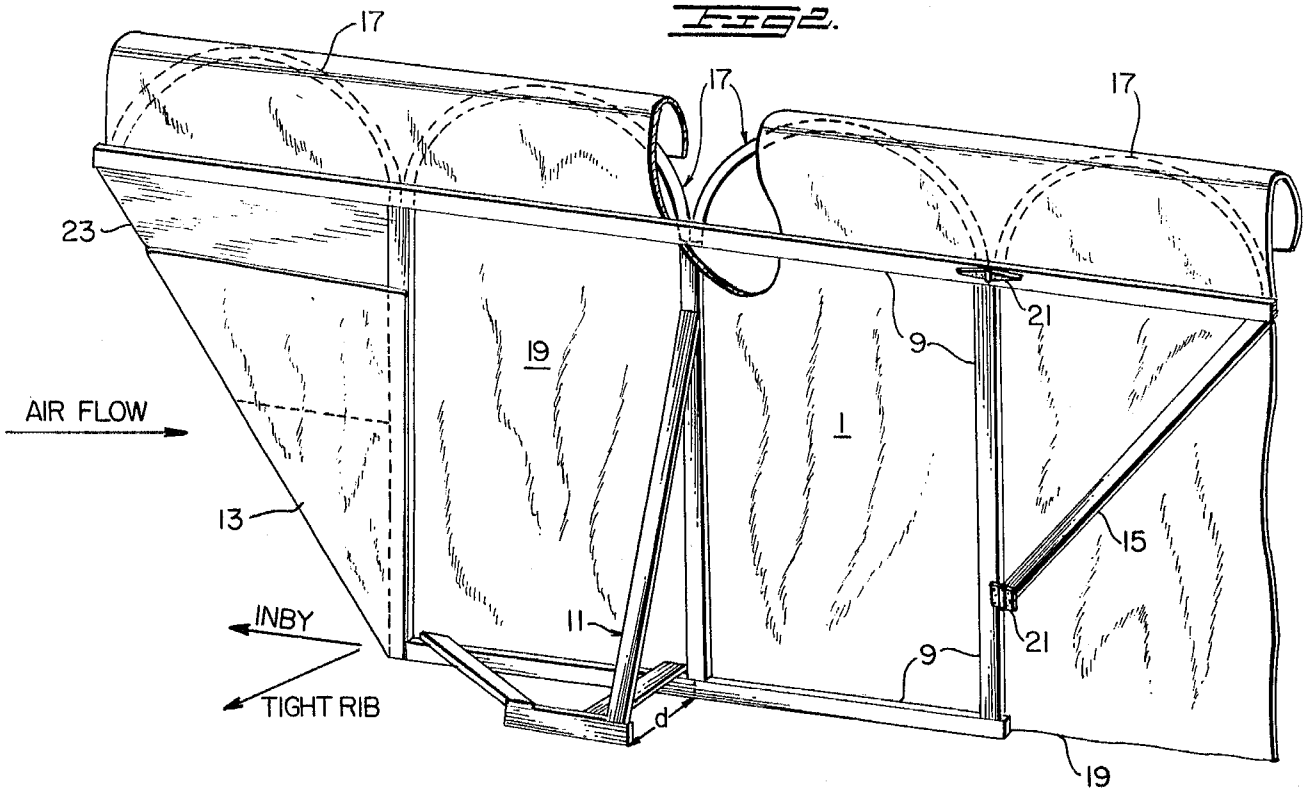
FIG. 2 depicts the preferred embodiment of this invention with a portion of its brattice cloth cut away to show part of two flexible upper loop supports.

FIG. 2 shows the preferred embodiment of the FIG. 1 slideboard forming the invention as viewed from the rib. Part of the brattice cloth has been shown in cutaway section to better illustrate supporting structure especially the flexible upper supports. The basic components of the slideboard include the interconnected rigid main frame members 9, the extending rib strut and outrigger 11, the front or inby reinforced section 13, the rear or outby section 15, the flexible identical curved half loops of hose 17 (four shown), and the gas impervious layer of brattice cloth 19. Also shown are the two hinges 21 which vertically support the outby frame/brattice/loop hose section 15. And there is a section of plywood 23 used to provide additional support and rigidity to the inby section 13.

The frame numbers 9 as well as the support for rib strut 11 can be made from 2 by 4 inch lumber with the boards being fixed together and oriented so that their narrow edge faces into the air stream. This will both increase the rigidity of the frame and reduce air friction. As shown, the rib strut is attached to the frame at two positions by a horizontal support near its lower portion at approximately the center and also at a third position higher up. It extends outwardly the distance d and thereby functions as a spacer to separate the frame from the mine wall and prevents high airflows from pulling the slideboard into the rib. It also provides the vertical self-support desired, a low friction sliding surface, and a pivot point. Since, impact from the mining machine normally occurs at the inby end of the slideboard and the miner slant cuts into the tight rib, when impact occurs the inby end of the slideboard will move into the rib. The plywood panel at the front end provides additional rigidity at the point of highest stress and its trapezoidal shape helps to prevent damage from the mining machine. The mining machine's left fender will normally fit under the bottom of this trapezoidal member, thereby preventing impact. The half loops of flexible hose—four shown—are placed on the far side of the brattice cloth from the wall and allow the slideboard's upper portion to conform to various irregularities in the mine roof and yet still provide an effective air seal between the roof and the slideboard. By placing the hose sections on the far side of the frame members away from the wall, the probability that the upper brattice cloth, which is attached to the half loops, from being sucked into the rib is reduced. The brattice cloth is fixed to the frame members and half loops on the far side of the nearest wall rib with portions extending over the loops and past the rear overlapping section. Any conventional securing means, such as nails, screws or adjustable hose clamps, may be used to secure the brattice to these parts.

As the continuous mining machine advances into the working face (to the right in FIG. 1), the slideboard is either pulled along the floor by attaching it to the machine or by a man pushing it while standing outby the last roof bolt. This allows the inby edge of the slideboard to be kept within ten feet of the working face until its length is exhausted and there is no overlapping with the line brattice 3.

It is apparent that many changes can be made to the materials, design, and other variables for the preferred embodiment shown in FIG. 2. None of these changes should be used to limit the scope and extent of the invention which is to be measured only by the claims that follow:

We claim:

1. A self-supporting movable slideboard apparatus for use in improving underground mine face ventilation in conjunction with a stationary line brattice comprising:

a main frame assembly extending in a vertical and horizontal direction and having a plurality of interconnected rigid frame support members, at least one of the members being a horizontal member in slideable contact with the mine floor;

a plurality of flexible supports mounted on said main frame and extending in seriatim the length thereof and upwardly therefrom to engage the mine roof in an operative mode;

a vertical support assembly attached to the main frame near its lower portion and extending in a tranverse direction therefrom to act as a support and spacer between the apparatus and an adjacent mine wall;

vertical pivot means connecting at least two of said rigid frame support members together located towards the rear of the sideboard apparatus; and a layer of air impervious material covering the main frame and flexible support to control and direct the passage of air between the appratus and an adjacent mine wall whereby the rear portion of the apparatus overlaps the line brattice used therewith.

2. The apparatus of claim 1 wherein each of the flexible supports is half-looped in shaped with the air impervious layer extending completely over its entire side which is nearest the extending vertical support assembly, said half-loops being fixed to the main frame assembly at their free ends on the side thereof opposite to the vertical support assembly.

3. The apparatus of claim 1 wherein the vertical pivot means are hinges that hold the rear most rigid frame section to the remainder of the assembly, said rear frame section having a flexible support mounted thereon with the air impervious material completely overlapping one side of the flexible support and the rear frame section.

4. The apparatus of claim 1 also including a rigid panel attached to the front end of the main frame assembly to provide additional strength and rigidity thereto.

5. The apparatus of claim 1 wherein the vertical support assembly has several frame members joined together with at least three of them being attached to the main frame assembly, the lowest most members of the support assembly being trapezoidal in outline when viewed from above.

* * * * *